US010415339B2

(12) United States Patent
Garro et al.

(10) Patent No.: US 10,415,339 B2
(45) Date of Patent: Sep. 17, 2019

(54) COLLET CONNECTOR SYSTEMS AND METHODS

(71) Applicant: Cameron International Corporation, Houston, TX (US)

(72) Inventors: Juan Alexander Garro, Katy, TX (US); Adam Joseph Christopherson, Cypress, TX (US); Peter Peng Swee Chan, Houston, TX (US)

(73) Assignee: Cameron International Corporation, Houston, TX (US)

( * ) Notice: Subject to any disclaimer, the term of this patent is extended or adjusted under 35 U.S.C. 154(b) by 0 days.

(21) Appl. No.: 15/486,997

(22) Filed: Apr. 13, 2017

(65) Prior Publication Data

US 2018/0298698 A1 Oct. 18, 2018

(51) Int. Cl.
*E21B 17/08* (2006.01)
*E21B 33/038* (2006.01)

(52) U.S. Cl.
CPC ..... *E21B 33/038* (2013.01)

(58) Field of Classification Search
CPC ..... E21B 33/038; E21B 33/064
See application file for complete search history.

(56) References Cited

U.S. PATENT DOCUMENTS 3,071,188 A * 1/1963 Raulins ..... E21B 33/038 166/340
4,049,297 A 9/1977 Reneau
4,337,971 A * 7/1982 Kendrick ..... F16L 37/121 285/315
4,477,105 A * 10/1984 Wittman ..... F16L 27/04 285/18
4,496,172 A * 1/1985 Walker ..... F16L 37/002 285/18
4,516,795 A * 5/1985 Baugh ..... E21B 33/038 285/315

(Continued)

OTHER PUBLICATIONS

Han, et al., Design Verification Analysis for a Subsea External Tieback Connector Bending Capacity Using API 17TR8 Criteria, moedllingProceedings of the ASME 2016 Pressure Vessels & Piping Conference, Jul. 17-21, 2016, PVP2016-63052, Vancouver, CA, 10 pgs.

(Continued)

*Primary Examiner* — James G Sayre
(74) *Attorney, Agent, or Firm* — Fletcher Yoder, P.C.

(57) ABSTRACT

A connector system configured to couple a first tubular member to a second tubular member includes a body, an outer sleeve positioned circumferentially about the body, and an actuator assembly positioned within an annular space defined between the body and the outer sleeve. The actuator assembly includes one or more piston rods, a primary piston ring coupled to respective first ends of the one or more piston rods, and an actuator ring coupled to respective second ends of the one or more piston rods, wherein the actuator assembly is configured to move axially within the annular space to drive multiple collet segments from an unlocked position in which the multiple collet segments do not engage the first tubular member and a locked position in which the multiple collet segments engage the first tubular member.

20 Claims, 9 Drawing Sheets

(56) References Cited

U.S. PATENT DOCUMENTS

| | | | | |
|---|---|---|---|---|
| 4,526,406 | A * | 7/1985 | Nelson | E21B 33/038 285/18 |
| 4,693,497 | A * | 9/1987 | Pettus | E21B 33/038 285/12 |
| 4,708,376 | A | 11/1987 | Jennings et al. | |
| 4,856,594 | A | 8/1989 | Jennings | |
| 6,234,252 | B1 | 5/2001 | Pallini, Jr. et al. | |
| 6,293,343 | B1 * | 9/2001 | Pallini, Jr. | E21B 33/038 166/345 |
| 6,540,024 | B2 | 4/2003 | Pallini et al. | |
| 8,016,042 | B2 | 9/2011 | Spiering et al. | |
| 8,474,537 | B2 | 7/2013 | Voss et al. | |
| 9,334,705 | B1 * | 5/2016 | Ward | E21B 33/038 |
| 2005/0206162 | A1 | 9/2005 | Biester | |
| 2007/0181309 | A1 | 8/2007 | Singeetham et al. | |

OTHER PUBLICATIONS

WorldOil HPHT, Drilling, Completions & Production Conference, Sep. 21-22, 2016, Houston, TX, HPHTConference.com, 22 pgs.
International Search Report and Written Opinion for PCT Application No. PCT/US2018/027397 dated Jul. 26, 2018, 16 pgs.

* cited by examiner

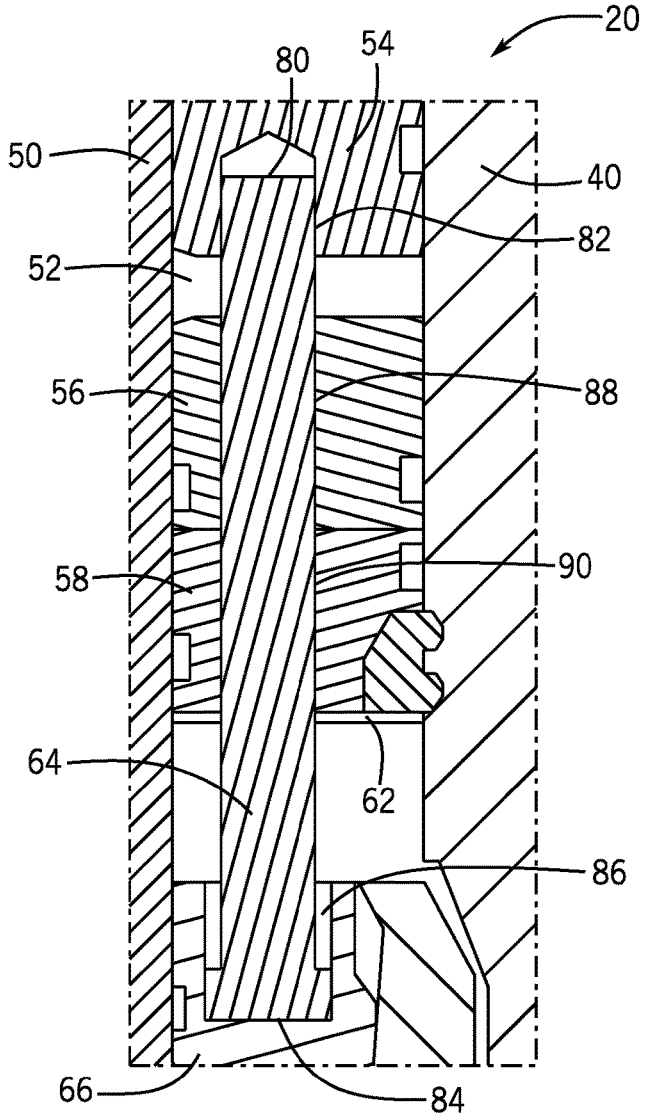
FIG. 3
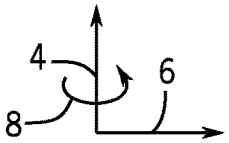

COLLET CONNECTOR SYSTEMS AND METHODS

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Natural resources, such as oil and gas, are used as fuel to power vehicles, heat homes, and generate electricity, in addition to various other uses. Once a desired resource is discovered below the surface of the earth, drilling and production systems are often employed to access and extract the resource. A subsea drilling and production system may include a riser that extends between a platform (e.g., drilling rig or surface vessel) at a sea surface and a wellhead assembly at a sea floor. In some subsea drilling and production systems, a connector may be provided between the riser and the wellhead to join these components to one another and to fluidly couple the riser to the wellhead, for example.

BRIEF DESCRIPTION OF THE DRAWINGS

Various features, aspects, and advantages of the present disclosure will become better understood when the following detailed description is read with reference to the accompanying figures in which like characters represent like parts throughout the figures, wherein:

FIG. 3 is a cross-sectional perspective view of the connector of FIG. 2;

DETAILED DESCRIPTION OF SPECIFIC EMBODIMENTS

Figure 1:
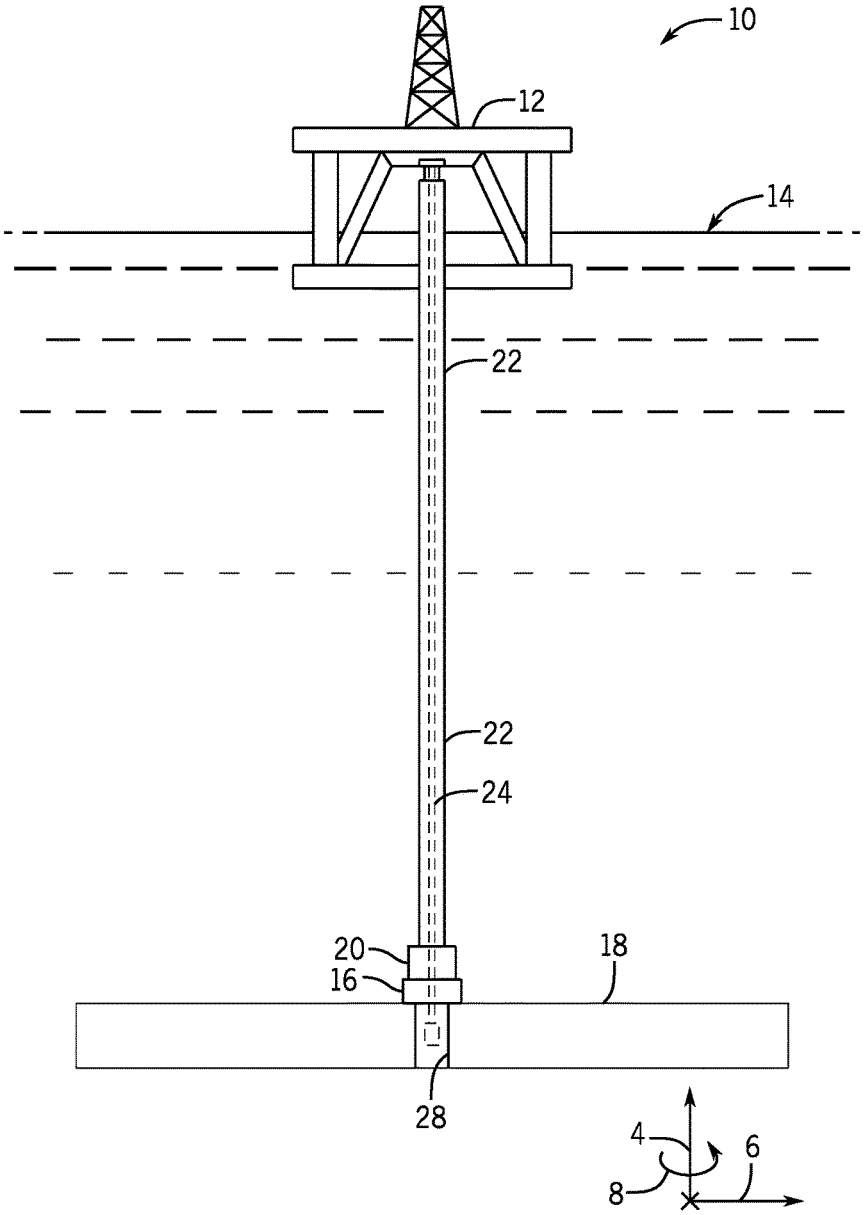
FIG. 1 is a schematic diagram of an offshore system, in accordance with an embodiment of the present disclosure.

One or more specific embodiments of the present disclosure will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The present disclosure is generally directed to a connector (e.g., a connector assembly, a connector system, an external tieback connector) that is configured to couple two tubular members (e.g., pipe, spool, housing, stress joint, riser, wellhead housing, or the like) of a drilling and production system to one another. For example, the connector may be utilized to couple a riser (e.g., a drilling riser and/or a production riser) to a housing of a wellhead. In certain embodiments, the connector includes a drive system (e.g., hydraulic drive system, pneumatic drive system, electric drive system) that is configured to drive a piston (e.g., annular piston) in an axial direction, which in turn drives collet segments between an unlocked position and a locked position to couple the riser to the housing of the wellhead. The disclosed embodiments may facilitate efficient coupling of the two tubular members with improved stress distribution and/or with relatively low hydraulic operating pressure to actuate the piston to drive the collet segments between the unlocked and the locked position, for example. Furthermore, the disclosed embodiments may provide a small diameter connector that is configured to fit through various openings (e.g., an opening in a rotary table at the drill floor or platform), the connector may demonstrate high bending capacity (e.g., higher than the first tubular member to which it attaches), and/or the connector may couple the two tubular components to one another even when misaligned (e.g., by more than about 2, 3, 4, or 5 degrees along an axial axis).

While certain embodiments disclosed herein relate to offshore (e.g., subsea) mineral extraction systems, it should be understood that the connector may be adapted for use within on-shore (e.g., land-based) mineral extraction systems. Furthermore, while certain embodiments described herein relate to using the connector between a wellhead and a riser of an offshore mineral extraction system to facilitate discussion, it should be understood that the connector may be adapted to couple any of a variety of tubular members (e.g., pipe, jumper, or the like) within any of a variety of mineral extraction systems.

FIG. 1 is an embodiment of an offshore mineral extraction system 10. To facilitate discussion, the offshore mineral extraction system 10 and its components may be described with reference to an axial axis or direction 4, a radial axis or direction 6, and a circumferential axis or direction 8. As shown, the offshore mineral extraction system 10 includes an offshore drilling rig or platform 12 at a sea surface 14 and a wellhead 16 positioned at a sea floor 18. A connector 20 (e.g., a connector assembly, a connector system, or an external tieback connector) is positioned between the wellhead 16 and a riser 22 (e.g., a drilling riser and/or a production riser), which extends from the connector 20 toward the platform 12. The connector 20 may be configured to couple (e.g., physically and fluidly couple) the wellhead 16 to the riser 22 to facilitate drilling and/or production operations. For example, drilling operations may be carried out by a drill string 24 (e.g., tubular string) that extends from the platform 12, through the riser 22, through the connector 20, through the wellhead assembly 16, and into a wellbore 28. During production operations, production fluids may flow from the wellbore 28 through the wellhead 16, through the connector 20, and through the riser 22 toward the platform 12.

Figure 2:
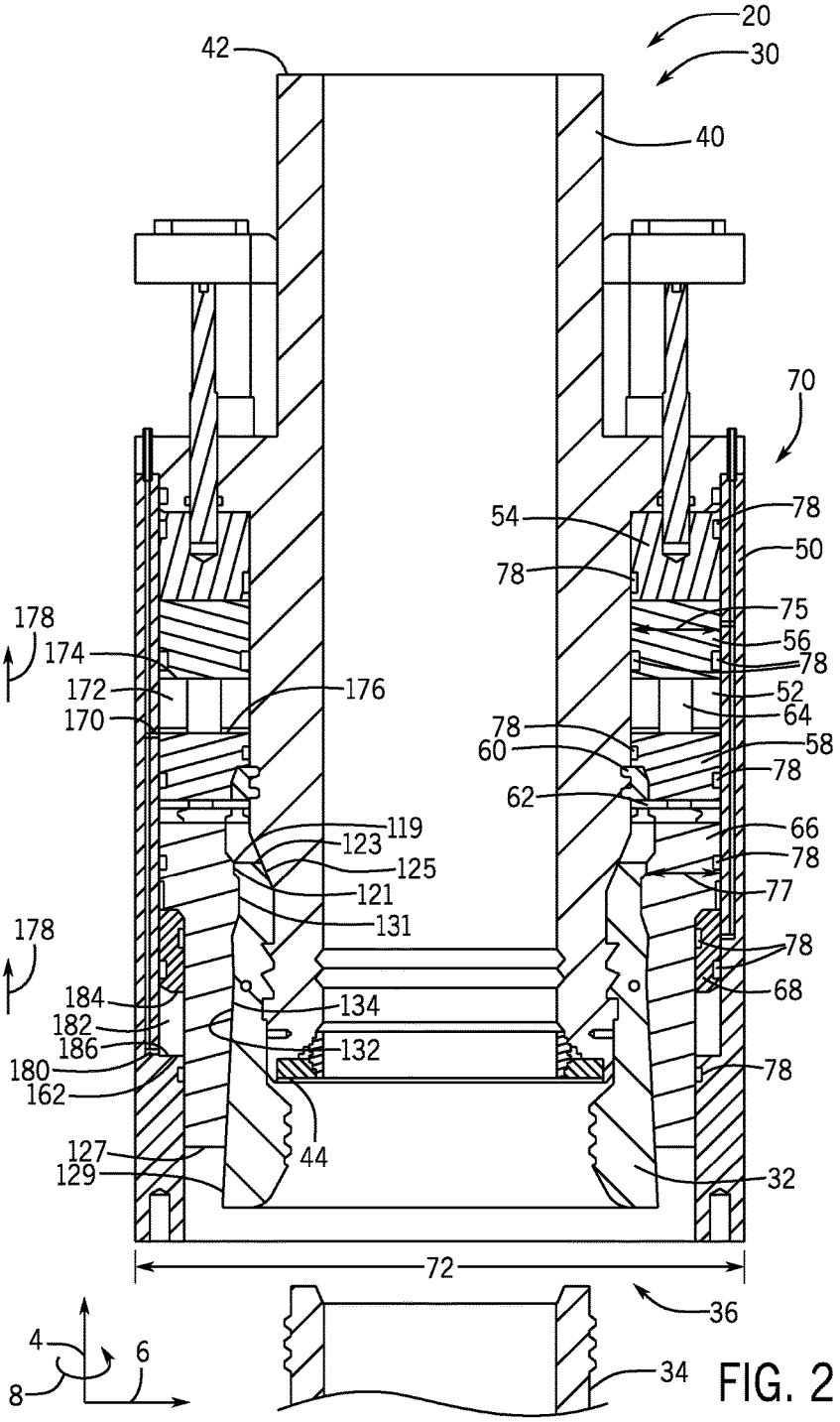
FIG. 2 is a cross-sectional side view of an embodiment of a connector that may be used within the offshore system of FIG. 1, wherein the connector is in an unlocked position.

FIG. 2 is a cross-sectional side view of an embodiment of the connector 20 in an unlocked position 30. In the unlocked position 30, collet segments 32 of the connector 20 are in an expanded position (e.g., radially expanded position) that enables the collet segments 32 to be positioned about and/or to receive a first tubular member 34 (e.g., a housing of the wellhead 16 shown in FIG. 1) within an opening 36 defined by the collet segments 32. In the unlocked position 30, the connector 20 is not locked to the first tubular member 34 and may move relative to the first tubular member 34.

In the illustrated embodiment, the connector 20 includes a body 40 (e.g., connector body, body center section, or stress joint) that extends from a first end 42 (e.g., proximal end) to a second end 44 (e.g., distal end). In certain embodiments, the first end 42 may be configured to couple to a second tubular member (e.g., the riser 22 shown in FIG. 1) via one or more fasteners (e.g., threaded fasteners, such as bolts), and the second end 42 may configured to contact and/or seal against the first tubular member 34 to facilitate coupling the first tubular member 34 and the second tubular member to one another. It should be appreciated that the first end 42 and the second end 44 may have any suitable form to facilitate connection to other components.

As shown, the connector 20 includes an outer sleeve 50 (e.g., outer annular sleeve or cylinder), and an annular space 52 is defined between the body 40 and the outer sleeve 50 along the radial axis 6. Multiple structures may be positioned within the annular space 52. In the illustrated embodiment, the connector 20 includes a primary piston 54 (e.g., annular piston), an upper secondary unlock piston 56 (e.g., annular piston), a retainer ring 58 (e.g., annular retainer ring), a split lock ring 60 (e.g., annular ring), a stop plate 62 (e.g., annular plate), multiple piston rods 64, an actuator ring 66 (e.g., annular actuator ring), a lower secondary unlock piston 68 (e.g., annular piston), and multiple seals 78 (e.g., annular seals) positioned within the annular space 52. Together, the components within the annular space 52 may form an actuator assembly 70 (e.g., piston assembly) that is configured to drive the collet segments 32 between the unlocked position 30 and a locked position in which the collet segments 32 engage the first tubular member 34 to lock the connector 20 to the first tubular member 34, as discussed in more detail below.

As shown, the primary piston 54, the upper secondary unlock piston 56, the retainer ring 58, the multiple piston rods 64, and the actuator ring 66 are stacked vertically relative to one another along the axial axis 4. Each of the primary piston 54, the upper secondary unlock piston 56, and the retainer ring 58 extend radially between and seal against the body 40 and the outer sleeve 50. In the illustrated embodiment, a radial thickness 75 (e.g., a maximum radial thickness or width) of each of the primary piston 54, the upper secondary unlock piston 56, and the retainer ring 58 is substantially the same, and a radial thickness 77 (e.g., a maximum radial thickness or width) of the actuator ring 66 does not exceed the radial thickness 75. Thus, due at least in part to this stacked arrangement of the components vertically above the collet segments, the actuator assembly 70 is compact in the radial direction 6. The arrangement of these components within the annular space 52 may enable the connector 20 to have a small diameter 72 (e.g., less than approximately 150, 145, 140, 135, 130, 125, or 120 centimeters [cm], or between about 110 to 145 or 120 to 130 cm) so that the connector 20 may fit through an opening in the rotary table, for example.

FIG. 3 is a cross-sectional perspective view of a portion of an embodiment of the connector 20 taken in a plane that extends through one of the piston rods 64. The connector 20 may include multiple piston rods 64 (e.g., 2, 3, 4, 5, 6, 7, 8, 9, 10, or more) positioned at discrete locations about the circumference of the connector 20, and each piston rod 64 may be coupled to the primary piston 54 and the actuator ring 66. In the illustrated embodiment, respective first ends 80 of each piston rod 64 are coupled to the primary piston 54 (e.g., threadably coupled via corresponding threads at a threaded interface 82), and respective second ends 84 of each piston rod 64 are coupled to the actuator ring 66 (e.g., threadably coupled, such as via respective gland nuts 86). Thus, the primary piston 54, the piston rod 64, and the actuator ring 66 may move together within the annular space 52 defined between the body 40 and the outer sleeve 50. In the illustrated embodiment, the upper secondary unlock piston 56 includes an opening 88 (e.g., axially-extending opening or through-hole) and the retainer ring 58 includes an opening 90 (e.g., axially-extending opening or through-hole) that slideably support the piston rod 64 (e.g., the piston rod 64 may move through the openings 88, 90).

Figure 4:
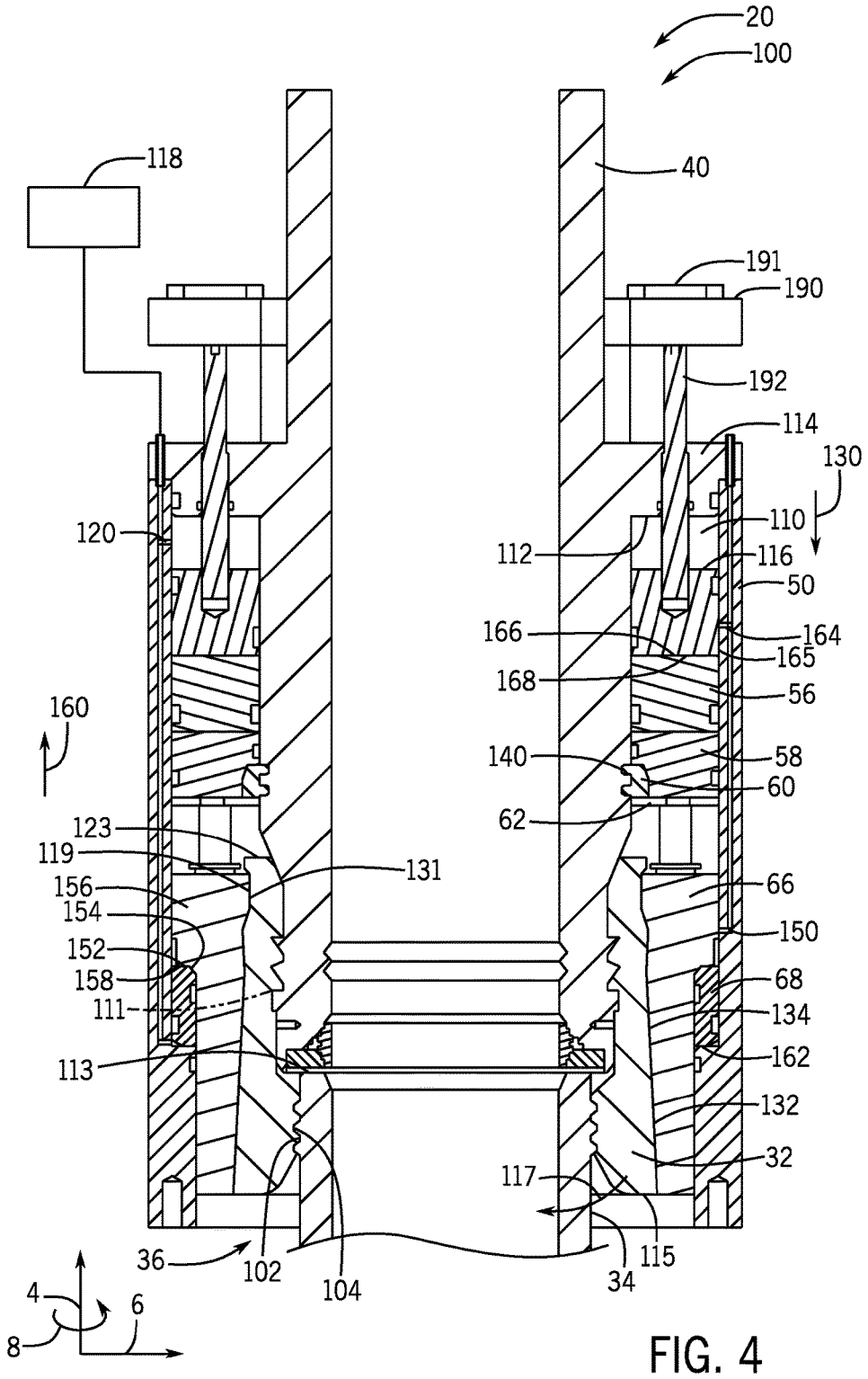
FIG. 4 is a cross-sectional side view of the connector of FIG. 2, wherein the connector is in a locked position.

FIG. 4 is a cross-sectional side view of an embodiment of the connector 20 in a locked position 100. In the locked position 100, collet segments 32 of the connector 20 are in a collapsed position (e.g., radially collapsed position) that enables the collet segments 32 to contact and engage the first tubular member 34. In particular, in the locked position 100, respective radially-inner surfaces 102 of the collet segments 32 contact and engage a radially-outer surface 104 (e.g., annular surface) of the first tubular member 34, thereby locking the connector 20 to the first tubular member 34 and blocking movement of the connector 20 relative to the first tubular member 34.

In operation, once the first tubular member 34 is positioned within the opening 36 defined by the collet segments 32, the actuator assembly 70 may be actuated to drive the collet segments 32 from the unlocked position 30 to the locked position 100. As shown, the annular space 52 includes a first sealed space 110 (e.g., annular space) defined between the body 40 and the outer sleeve 50 along the radial axis 6, as well as between an axially-facing surface 112 (e.g., annular surface) of a flange 114 (e.g., annular flange) of the body 40 and an axially-facing surface 116 (e.g., annular surface) of the primary piston 54 along the axial axis 4. When a fluid (e.g., hydraulic fluid from a fluid source 118) is provided via a first line 120 (e.g., extending through the outer sleeve 50) to the first sealed space 110, the fluid exerts a force on the axially-facing surface 116 of the primary piston 54 and drives the primary piston 54, as well as the attached piston rod 64 and the actuator ring 66, axially toward the collet segments 32, as shown by arrow 130. Thus, the primary piston 54, the piston rod 64, and the actuator ring 66 move axially relative to the body 40 and the outer sleeve 50, as well as relative to the collet segments 32.

As shown, the actuator ring 66 and the collet segments 32 include corresponding tapered surfaces 132, 134 (e.g., opposed tapered surfaces) to facilitate axial movement of the actuator ring 66 relative to the collet segments 32 and to enable the actuator ring 66 to drive and to hold the collet segments 32 in the locked position 100. The actuator ring 66 may be self-locking, such that the actuator ring 66 is configured to maintain the collet segments 32 in the locked position 100, even if the fluid pressure within the first sealed space 110 is removed or reduced, for example.

The actuator ring 66 and the collet segments 32 may have a geometry and configuration that enables the collet segments 32 to generally pivot (e.g., about a pivot axis 111, which may be located proximate to an interface between respective protrusions of the collet segments 32 and an annular groove of the body 40) and/or that causes an end 115 (e.g., distal end) of the collet segments 32 to deflect or rotate radially-inwardly (e.g., about the pivot axis 111) as the collet segments 32 move from the unlocked position 30 to the locked position 100, as shown by arrow 117. For example, with reference to FIG. 2, in the unlocked position 30, a first portion 119 (e.g., radially-innermost portion) of the tapered surface 132 (e.g., conical surface or annular surface) of the actuator ring 66 may contact a first portion 121 (e.g., radially-outwardly extending portion) of the tapered surface 134 of each collet segment 32, thereby driving another end 123 (e.g., proximal end) of the collet segments 32 radially-inwardly into a recess 125 (e.g., annular recess or portion having reduced thickness) formed in the body 40. Additionally, in the illustrated embodiment, an end 127 (e.g., distal end) of the actuator ring 66 may be positioned vertically above respective radially-extending portions 129 of the collet segments 32. With reference to FIG. 4, the first portion 119 of the tapered surface 132 of the actuator ring 66 may slide into a groove 131 formed in each collet segment 32, and the end 127 of the actuator ring 66 may slide into a position to circumferentially surround the radially-extending portions 129 of the collet segments 32, thereby enabling the ends 123 of the collet segments 32 to move radially-outwardly, driving the ends 115 of the collet segments 32 to move radially-inwardly, and causing the collet segments 32 to pivot or rotate into the locked position 100. Such pivoting motion may enable the connector 20 to provide a relatively large opening 36 to facilitate positioning the connector 20 about the first tubular member 34, and the configuration of the components (e.g., the tapered surface 132 and the tapered surface 134) may enable the actuator ring 66 to generate a large pre-load between the body 40 and the first tubular member 34 to compress a seal 113 (e.g., annular seal or gasket) between the body 40 and the first tubular member 34, thereby coupling these components together, for example.

As the primary piston 54, the piston rod 64, and the actuator ring 66 move axially to drive the collet segments 32 from the unlocked position 30 shown in FIG. 2 to the locked position 100 shown in FIG. 4, the retainer ring 58 remains in a fixed position relative to the body 40 and the outer sleeve 50. In certain embodiments, the retainer ring 58 may be fixed within the annular space 52 via a coupling (e.g., threaded coupling) to the body 40 and/or the outer sleeve 50. In some embodiments, the retainer ring 58 may be coupled (e.g., threadably coupled) to the split ring 60, which engages corresponding grooves 140 formed in the body 40 and thereby blocks movement of the retainer ring 58 relative to the body 40. In certain embodiments, the stop plate 62 may be provided to support and/or to maintain the split ring 60 within the corresponding grooves 140 as the connector moves between the unlocked position 30 and the locked position 100. The stop plate 62 may be fixed within the annular space via a coupling (e.g., threaded coupling) to the body 40 and/or the retainer ring 40. In some embodiments, the stop plate 62 may be an extension of the retainer ring 58 or the body 40 that extends radially through the annular space 52 to support the split ring 60, for example. In operation, the retainer ring 58 may support the piston rod 64 (e.g., hold the piston rod 64 in a vertical position along the axial axis 4) as the piston rod 64 slides through the retainer ring 58 and moves through the annular space 52 and/or the split ring 60 may be configured to transfer loads (e.g., caused by movement of the piston rod 64) to the body 40.

To drive the connector 20 from the locked position shown in FIG. 4 to the unlocked position 30 shown in FIG. 3, a fluid (e.g., hydraulic fluid from the fluid source 118) may be provided via a second line 150 (e.g., extending through the outer sleeve 50) to a second sealed space 152 (e.g., annular space) defined between the actuator ring 66 and the outer sleeve 50 along the radial axis 6, as well as between an axially-facing surface 154 (e.g., annular surface) of a shoulder 156 (e.g., radially-outwardly extending shoulder) of the actuator ring 66 and an axially-facing surface 158 (e.g., annular surface) of the lower secondary unlock piston 68 along the axial axis 4. The fluid exerts a force on the axially-facing surface 154 of the actuator ring 66 and drives the actuator ring 66, as well as the attached piston rod 64 and the primary piston 54, axially away from the collet segments 32, as shown by arrow 160.

Additionally or alternatively, a fluid (e.g., hydraulic fluid from the fluid source 118) may be provided via a third line 164 (e.g., extending through the outer sleeve 50) to a third sealed space 165 (e.g., annular space) defined between the primary piston 54 and the outer sleeve 50 along the radial axis 6, as well as between an axially-facing surface 166 (e.g., annular surface) of the primary piston 54 and an axially-facing surface 168 (e.g., annular surface) of the upper secondary unlock piston 56 along the axial axis 4. The fluid exerts a force on the axially-facing surface 166 of the primary piston 54 and drives the primary piston 54, as well as the attached piston rod 64 and the actuator ring 66, axially away from the collet segments 32, as shown by arrow 160. In some embodiments, the fluid may be provided to the second sealed space 152 and the third sealed space 165 simultaneously to provide a greater driving force to unlock the connector 20 from the first tubular member 34.

To facilitate unlocking the connector 20 from the first tubular member 34, the connector 20 may include one or more secondary unlock pistons, such as the illustrated upper secondary unlock piston 56 and the lower secondary unlock piston 68. In certain embodiments, the secondary unlock pistons are redundant features utilized to unlock the connector 20 under various circumstances, such as if the fluid provided to the second sealed space 152 and/or the third sealed space 165 does not drive the connector 20 from the locked position 100 to the unlocked position 30 (e.g., due to failure of seals 78, failure to maintain pressure within the sealed spaces 152, 165, or the like). In the illustrated embodiment, the upper secondary unlock piston 56 is slideably coupled to the piston rod 64, and the lower secondary unlock piston 68 is positioned between the actuating ring 66 and the outer sleeve 50 along the radial axis 6 and supported by a shoulder 162 (e.g., annular shoulder or radially-inwardly extending shoulder) of the outer sleeve 50.

Thus, with reference to FIG. 2, a fluid (e.g., hydraulic fluid from the fluid source 118) may be provided via a fourth line 170 (e.g., extending through the outer sleeve 50) to a fourth sealed space 172 (e.g., annular space) defined between the body 40 and the outer sleeve 50 along the radial axis 6, as well as between an axially-facing surface 174 (e.g., annular surface) of the upper secondary unlock piston 56 and an axially-facing surface 176 (e.g., annular surface) of the retainer ring 58 along the axial axis 4. The fluid exerts a force on the axially-facing surface 174 of the upper secondary unlock piston 56 and drives the upper secondary unlock piston 56, as well as the attached piston rod 64, primary piston 54, and actuator ring 66, axially away from the collet segments 32, as shown by arrow 178.

Additionally or alternatively, with reference to FIG. 2, a fluid (e.g., hydraulic fluid from the fluid source 118) may be provided via a fifth line 180 (e.g., extending through the outer sleeve 50) to a fifth sealed space 182 (e.g., annular space) defined between the actuating ring 66 and the outer sleeve 50 along the radial axis 6, as well as between an axially-facing surface 184 (e.g., annular surface) of the lower secondary unlock piston 68 and an axially-facing surface 186 (e.g., annular surface) of the shoulder 162 of the outer sleeve 50 along the axial axis 4. The fluid exerts a force on the axially-facing surface 184 of the lower secondary unlock piston 68 and drives the lower secondary unlock piston 68 axially, as shown by arrow 178. As the lower secondary unlock piston moves axially, the axially-facing surface 158 of the lower secondary unlock piston 68 may contact the axially-facing surface 154 of the shoulder 156 of the actuating ring 56, thereby driving the actuating ring 66, as well as the attached piston rod 64 and primary piston 54, axially away from the collet segments 32. It should be understood that the fluid may be provided to the second sealed space 152, the third sealed space 165, the fourth sealed space 172, and/or the fifth sealed space 182 simultaneously or in any sequence to unlock the connector 20 from the first tubular member 34.

As shown in FIG. 4, the connector 20 may include an override plate 190 (e.g., annular plate) coupled to override rods 192 (e.g., 1, 2, 3, 4, 5, 6, 7, 8, 9, 10, or more rods) positioned circumferentially about the connector 20 via respective fasteners 191 (e.g., threaded fasteners, such as bolts). The override rods 192 are coupled to the primary piston 54 (e.g., threadably coupled), such that lifting or separating (e.g., via a jacking tool or lifting tool, which may be operated by a remotely operated vehicle [ROV] or an autonomously operated vehicle [AUV]) the override plate 190 away from the flange 114 of the body 40 may drive the connector 20 from the locked position 100 to the unlocked position 30. The override plate 190 may be utilized when the actuator assembly 70 is unable to unlock the connector 20, for example.

Figure 5:
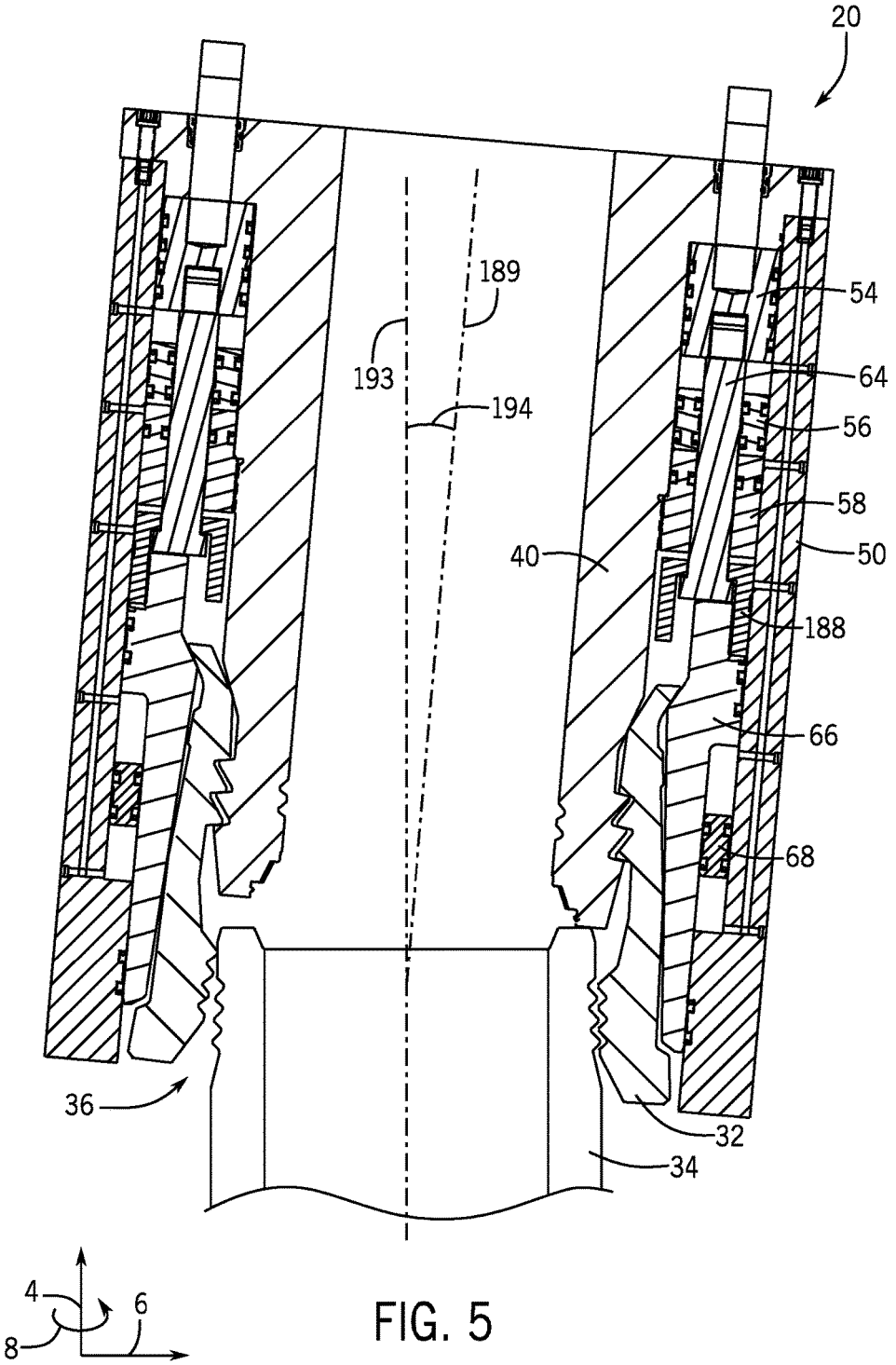
FIG. 5 is a cross-sectional schematic view of an embodiment of a connector that may be used within the offshore system of FIG. 1, wherein the connector is misaligned with a first tubular member.

FIG. 5 is a cross-sectional schematic view of an embodiment of the connector 20 that is misaligned with the first tubular member 34. As shown, the connector 20 illustrated in FIG. 5 includes many of the same components illustrated in FIG. 4, although an adapter 188 (e.g., annular adapter) is provided to couple the piston rods 64 to the actuator ring 66. In the illustrated embodiment, a central axis 189 (e.g., longitudinal axis) of the body 40 of the connector 20 is at an angle 194 relative to a central axis 193 (e.g., longitudinal axis) of the first tubular member 34. However, the opening 36 defined by the collet segments 32 of the connector 20 may still receive and/or fit around the first tubular member 34. As noted above, the geometry and configuration of the actuator ring 66 and the collet segments 32 may enable the collet segments 32 to pivot from the unlocked position 30 to the locked position 100, and thus, the opening 36 may generally be larger (e.g., as compared to connectors 20 having collet segments 32 that do not pivot) and still enable the connector 20 to achieve the locked position 100. In some embodiments, the connector 20 may be configured to fit around the first tubular member 34 and/or to lock to the first tubular member 34 even when the angle 194 between the central axis 189 of the connector 20 and the central axis 193 of the first tubular member 34 is greater than about 2, 3, 4, 5, 6, 7, 8, 9, or 10 degrees or between about 1 to 10, 2 to 8, or 3 to 5 degrees.

Figure 6:
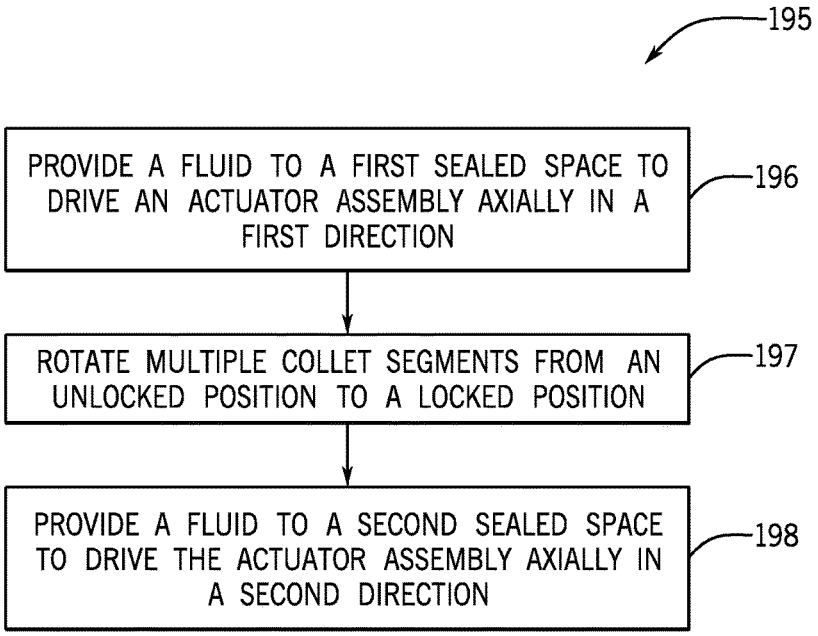
FIG. 6 is a flow diagram of an embodiment of a method for joining two tubular components of a mineral extraction system to one another using the connector of FIGS. 2-4.

FIG. 6 is a flow diagram of an embodiment of a method 195 for joining two components (e.g., the first tubular member 34 and the body 40, which may in turn be coupled to another tubular component, such as the riser 22) of the mineral extraction system 10 to one another using the connector 20 illustrated in FIGS. 2-5. The method 195 includes various steps represented by blocks. It should be noted that some or all of the steps of the method 195 may be performed as an automated procedure by an automated system (e.g., an ROV or an AOV system) and/or some or all of the steps of the method 130 may be performed manually by an operator (e.g., via controlling the ROV or the AUV). Although the flow chart illustrates the steps in a certain sequence, it should be understood that the steps may be performed in any suitable order and certain steps may be carried out simultaneously, where appropriate. Further, certain steps or portions of the method 195 may be omitted and other steps may be added.

In step 196, a fluid may be provided to a first sealed space (e.g., the first sealed space 110) to drive the primary piston 54, the piston rod 64, and the actuator ring 66 of the actuator assembly 70 axially in a first direction, as shown by arrow 130 in FIG. 4. Such axial movement may cause movement (e.g., rotation) of the multiple collet segments 32 from the unlocked position 30 to the locked position 100, in step 197. In particular, the corresponding tapered surfaces 132, 134 of the actuator ring 66 and the multiple collet segments 32, as well as various other features (e.g., the portion 119, the radially-extending portions 129, and the like), enable the actuator ring 66 to slide along the multiple collet segments 32 and enable the multiple collet segments 32 to move (e.g., rotate) as the actuator ring 66 slides along the multiple collet segments 32.

In step 198, a fluid may be provided to the second sealed space (e.g., the second sealed space 152 and/or the third sealed space 165) to drive the primary piston 54, the piston rod 64, and the actuator ring 66 of the actuator assembly 70 axially in a second direction, as shown by arrow 178 in FIG. 2. Such axial movement may cause the multiple collet segments 32 to move (e.g., rotate) from the locked position 100 to the unlocked position 30. As noted above, in some embodiments, the fluid may be provided to the second sealed space 152 and the third sealed space 165 simultaneously to provide a greater driving force to unlock the connector 20 from the first tubular member 34. Additionally or alternatively, the fluid may be provided to the fourth sealed space 172 and/or the fifth sealed space 182 to drive the secondary unlock pistons 56, 68 to provide a greater driving force to unlock the connector 20 from the first tubular member 34.

Figure 8:
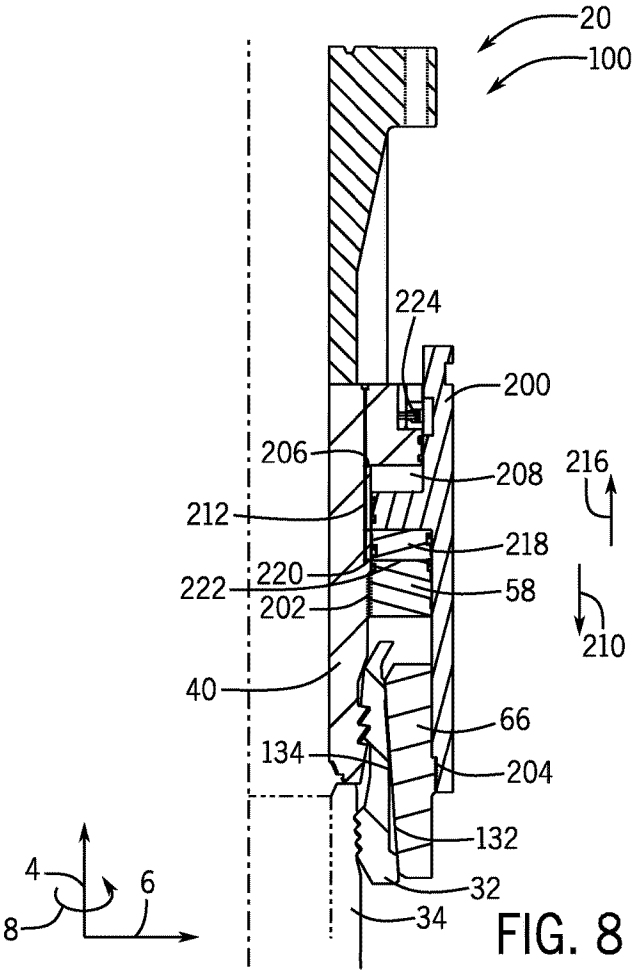
FIG. 8 is a cross-sectional side view of an embodiment of the connector of FIG. 7, wherein the connector is in a locked position.
Figure 7:
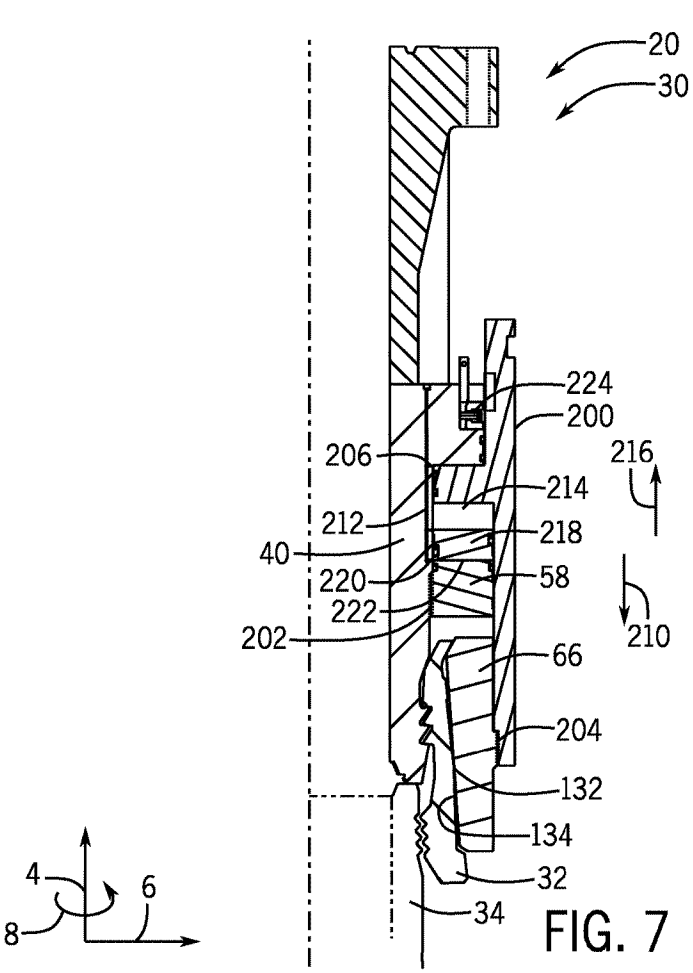
FIG. 7 is a cross-sectional side view of an embodiment of a connector that may be used within the offshore system of FIG. 1, wherein the connector includes a movable outer sleeve and the connector is in an unlocked position.

FIGS. 7 and 8 are a cross-sectional side views of a portion of an embodiment of the connector 20 having a movable outer sleeve 200 (e.g., annular sleeve). In FIG. 7, the connector 20 is in the unlocked position 30, and in FIG. 8, the connector 20 is in the locked position 100. As shown, the connector 20 includes collet segments 32, the body 40, the retainer ring 58, and the actuator ring 66. In the illustrated embodiment, the retainer ring 58 is in a fixed position relative to the body 40 (e.g., via a threaded coupling or interface 202), and the actuator ring 66 is in a fixed position relative to the movable outer sleeve 200 (e.g., via a threaded coupling or interface 204), such that the actuator ring 66 moves axially with the movable outer sleeve 200.

In operation, fluid may be provided (e.g., via a first line 206 formed in the body 40) to a first sealed space 208 (e.g., annular space) to drive the movable outer sleeve 200, as well as the attached actuator ring 66, axially in the direction of arrow 210. The corresponding tapered surfaces 132, 134 facilitate axial movement of the actuator ring 66 relative to the collet segments 32 and enable the actuator ring 66 to drive and to hold the collet segments 32 in the locked position 100. As shown, the collet segments 32 and the actuator ring 66 may include certain features described above with respect to FIGS. 2-5 that enable the collet segments 32 to pivot between the unlocked position 30 and the locked position 100.

To drive the connector 20 from the locked position 100 to the unlocked position 30, fluid may be provided (e.g., via a second line 212 formed in the body 40) to a second sealed space 214 (e.g., annular space) to drive the movable outer sleeve 200 axially in the direction of arrow 216. The connector 20 may include a secondary unlock piston 218 (e.g., annular piston), and fluid may additionally or alternatively be provided (e.g., via a third line 220 formed in the body 40) to a third sealed space 222 (e.g., annular space) to drive the secondary unlock piston 218 axially in the direction of arrow 216, such that the secondary unlock piston 218 contacts and drives the movable outer sleeve 200 axially in the direction of arrow 216. The illustrated embodiment includes a mechanical lock 224 (e.g., fastener) that may be manually engaged (e.g., via an ROV or an AUV) to secure the body 40 to the movable outer sleeve 200 (e.g., block relative movement).

Figure 10:
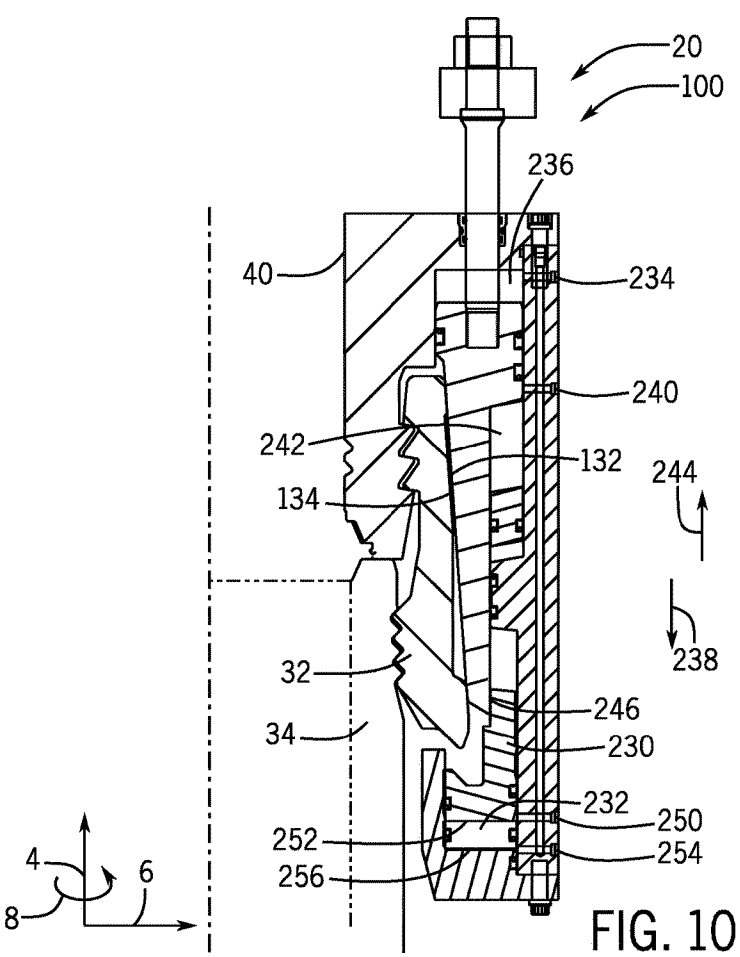
FIG. 10 is a cross-sectional side view of an embodiment of the connector of FIG. 9, wherein the connector is in a locked position.
Figure 9:
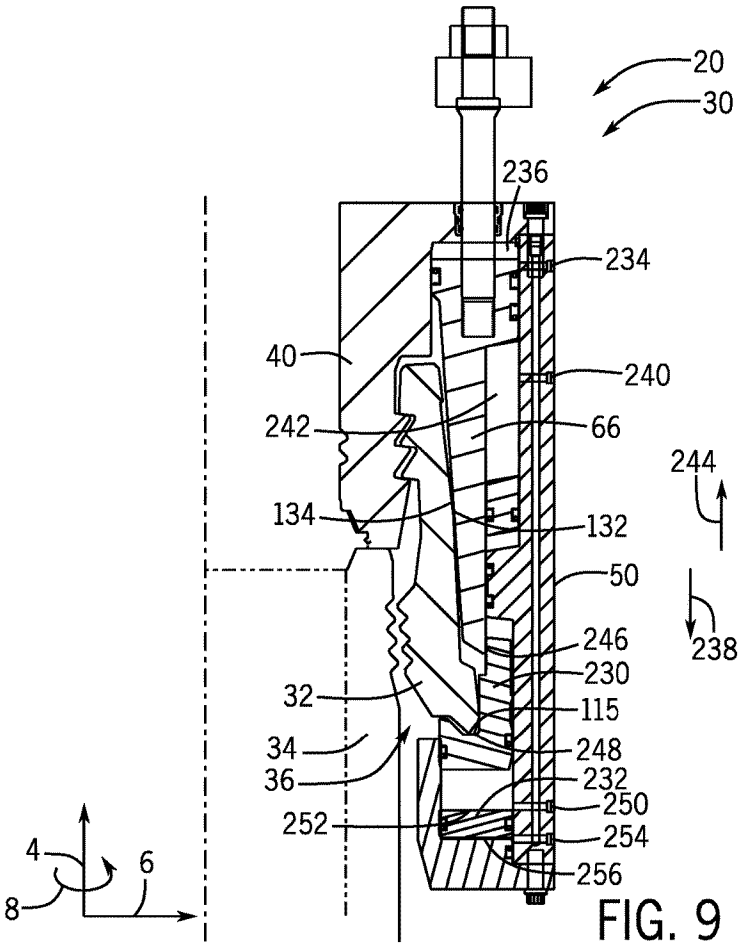
FIG. 9 is a cross-sectional side view of an embodiment of a connector that may be used within the offshore system of FIG. 1, wherein the connector includes a secondary unlock piston that is configured to engage collet segments and the connector is in an unlocked position.

FIGS. 9 and 10 are a cross-sectional side views of a portion of an embodiment of the connector 20 having a secondary unlock piston 230 (e.g., an upper secondary unlock piston, annular piston) that is configured to engage the collet segments 32. In FIG. 9, the connector 20 is in the unlocked position 30, and in FIG. 10, the connector 20 is in the locked position 100. As shown, the connector 20 includes collet segments 32, the body 40, the outer sleeve 50, and the actuator ring 66. The connector 20 also includes the secondary unlock piston 230 and a lower secondary unlock piston 232 (e.g., annular piston).

In operation, fluid may be provided (e.g., via a first line 234 formed in the outer sleeve 50) to a first sealed space 236 (e.g., annular space) to drive the actuator ring 66 axially in the direction of arrow 238. The corresponding tapered surfaces 132, 134 facilitate axial movement of the actuator ring 66 relative to the collet segments 32 and enable the actuator ring 66 to drive and to hold the collet segments 32 in the locked position 100. As shown, the collet segments 32 and the actuator ring 66 may include certain features described above with respect to FIGS. 2-5 that enable the collet segments 32 to pivot between the unlocked position 30 and the locked position 100.

To drive the connector 20 from the locked position 100 to the unlocked position 30, fluid may be provided (e.g., via a second line 240 formed in the outer sleeve 50) to a second sealed space 242 (e.g., annular space) to drive the actuator ring 66 axially in the direction of arrow 244. In certain embodiments, the connector 20 includes the secondary unlock piston 230, which may support the respective ends 115 of the collet segments 32 within a groove 248 (e.g., annular groove) when the connector 20 is in the unlocked position 30 and/or facilitate maintenance of the opening 36 to receive the first tubular member 34. In some embodiments, the secondary unlock piston 230 is coupled to the actuator ring 66 at an interface 246, and thus, moves with the actuator ring 66. In some embodiments, fluid may additionally or alternatively be provided (e.g., via a third line 250 formed in the outer sleeve 50) to a third sealed space 252 (e.g., annular space) to drive the secondary unlock piston 230 axially in the direction of arrow 244, such that the secondary unlock piston 230 engages the respective ends 115 of the collet segments 32 and/or drives the actuator ring 66 axially in the direction of arrow 244. In some embodiments, fluid may additionally or alternatively be provided (e.g., via a fourth line 254 formed in the outer sleeve 50) to a fourth sealed space 256 (e.g., annular space) to drive the lower secondary unlock piston 232 axially in the direction of arrow 244, such that the lower secondary unlock piston 232 contacts and drives the secondary unlock piston 232 axially in the direction of arrow 244. The embodiments illustrated in FIGS. 7-10 may be utilized to carry out the steps of the method 195 shown in FIG. 6. Additionally, it should be understood that any of the features shown and described with respect to FIGS. 2-10 may be combined in any suitable manner to facilitate connecting components together.

Figure 11:
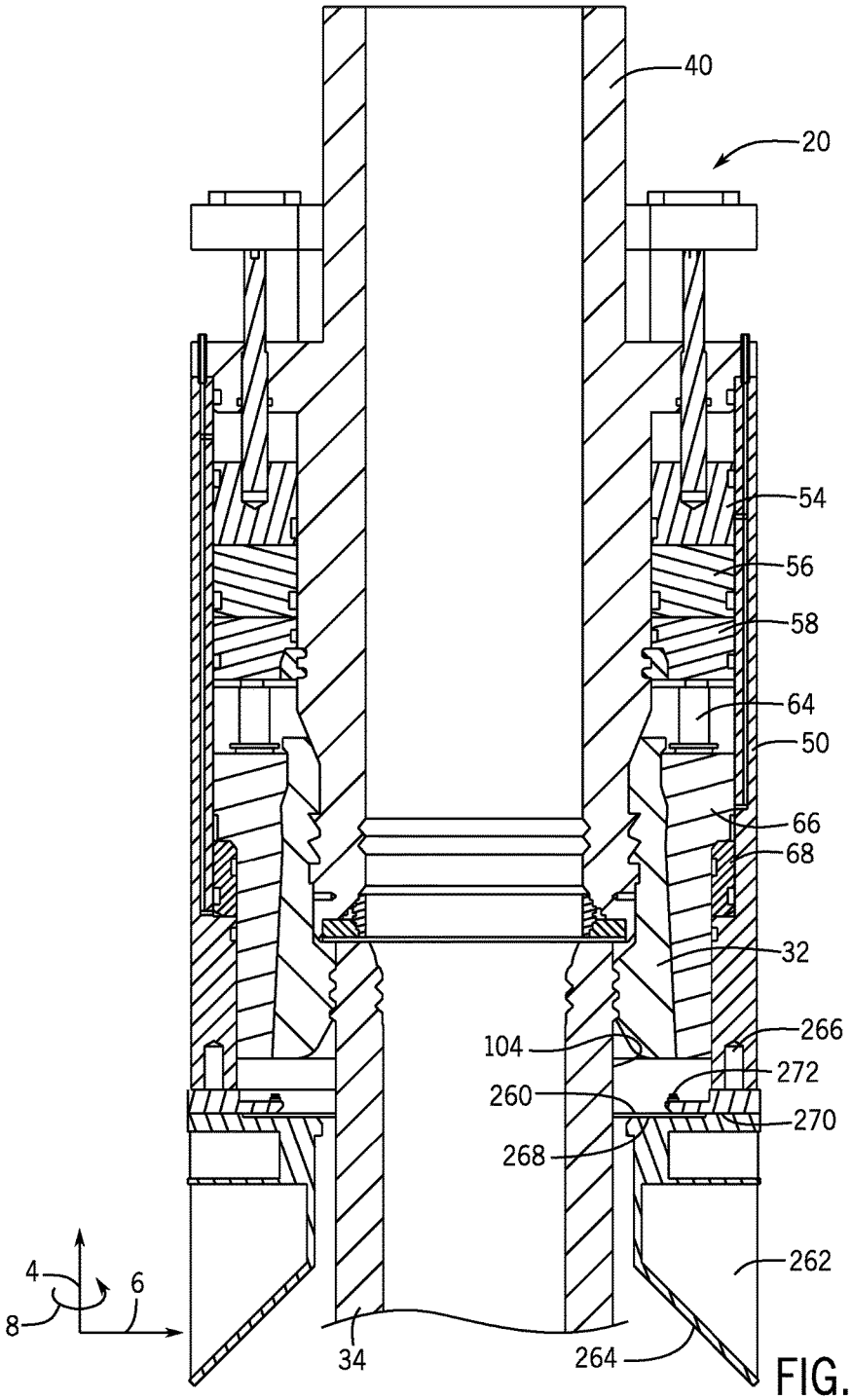
FIG. 11 is a cross-sectional side view of an embodiment of the connector of FIG. 2 having a barrier seal and a guide funnel.

FIG. 11 is a cross-sectional side view of an embodiment of the connector 20 of FIG. 2 having a seal 260 (e.g., annular seal or hydrate barrier) and a guide funnel assembly 262 (e.g., tapered annular funnel or frustroconical funnel). As shown, the guide funnel assembly 262 has a tapered surface 264 (e.g., annular surface) and extends axially from the outer sleeve 50 to guide the connector 20 into position about the first tubular member 34. In some embodiments, the guide funnel assembly 262 may have a circular cross-sectional shape (e.g., taken in a plane perpendicular to the axial axis 4) to facilitate coupling the connector 20 to the first tubular member 34; however, it should be understood that the guide funnel assembly 262 may have any of a variety of suitable geometries and cross-sectional shapes, including a rectangular cross-sectional shape, to facilitate coupling the connector 20 to the first tubular member 34. In the illustrated embodiment, the guide funnel assembly 262 is coupled to the outer sleeve 50 via a fastener 266 (e.g., threaded fastener, such as a bolt); however, it should be appreciated that the guide funnel assembly 262 may be coupled to the outer sleeve 50 via any suitable technique or device, or the guide funnel assembly 262 may be integrally formed with the outer sleeve 50 (e.g., a one-piece structure).

The seal 260 may be supported by the guide funnel assembly 262. For example, in the illustrated embodiment, the seal 260 is supported between a first support surface 268 (e.g., an axially-facing annular surface) and a second support surface 270 (e.g., an axially-facing annular surface) of the guide funnel assembly 262. In some embodiments, the seal 260 may clamped or held in place between the surfaces 268, 270, such as via one or more fasteners 272 (e.g., threaded fasteners, such as bolts). As shown, the seal 260 may contact and extend radially between the guide funnel assembly 262 and the first tubular member 34. In operation, the seal 260 is configured to contact and to seal against the radially-outer surface 104 (e.g., annular surface) of the first tubular member 34 while the connector 20 is in the locked position 100, thereby blocking fluid flow across the seal 260. It should be understood that the seal 260 and the guide funnel assembly 262 may be used with any of the connectors and various other features disclosed above with respect to FIGS. 2-10.

While the disclosure may be susceptible to various modifications and alternative forms, specific embodiments have been shown by way of example in the drawings and have been described in detail herein. However, it should be understood that the disclosure is not intended to be limited to the particular forms disclosed. Rather, the disclosure is to cover all modifications, equivalents, and alternatives falling within the spirit and scope of the disclosure as defined by the following appended claims.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A connector system configured to couple a first tubular member to a second tubular member, comprising:
- a body;
- an outer sleeve positioned circumferentially about the body;
- multiple collet segments that extend axially below the body, wherein each of the multiple collet segments comprises at least one protrusion that engages at least one groove of the body;
- an actuator assembly positioned within an annular space defined between the body and the outer sleeve, wherein the actuator assembly comprises:
  - one or more piston rods;
  - a primary piston ring coupled to respective first ends of the one or more piston rods; and
  - an actuator ring coupled to respective second ends of the one or more piston rods and positioned axially below the primary piston ring, wherein the actuator ring contacts the multiple collet segments, and the actuator assembly is configured to move axially within the annular space relative to the outer sleeve to drive the multiple collet segments from an unlocked position in which the multiple collet segments do not engage the first tubular member and a locked position in which the multiple collet segments engage the first tubular member.

2. The connector system of claim 1, wherein the multiple collet segments and the actuator ring comprise corresponding tapered surfaces to enable the actuator ring to drive the multiple collet segments from the unlocked position the locked position.

3. The connector system of claim 1, wherein the actuator assembly is configured to cause respective distal ends of the multiple collet segments to rotate radially-inwardly to move from the unlocked position to the locked position.

4. The connector system of claim 1, comprising a retainer ring positioned between the primary piston ring and the actuator ring along an axial axis, wherein the retainer ring comprises one or more openings through which the one or more piston rods slide as the actuator assembly moves axially within the annular space.

5. The connector system of claim 4, wherein the retainer ring is coupled to a split ring that is configured to engage a corresponding groove of the body to facilitate transfer of forces to the body.

6. The connector system of claim 1, comprising an upper secondary unlock piston ring positioned between the primary piston ring and the actuator ring along an axial axis, wherein the upper secondary unlock piston ring is configured to move axially toward the primary piston ring to contact and exert a force against the primary piston ring to facilitate driving the multiple collet segments from the locked position to the unlocked position.

7. The connector system of claim 1, comprising a lower secondary unlock piston ring positioned between the actuator ring and the body along a radial axis, wherein the lower secondary unlock piston ring is configured to move axially to contact and exert a force against the actuator ring to facilitate driving the multiple collet segments from the locked position to the unlocked position.

8. The connector system of claim 1, wherein the one or more piston rods extend in an axial direction.

9. The connector system of claim 1, comprising a hydraulic drive system, wherein the hydraulic drive system is configured to provide a fluid to a sealed space to drive the actuator assembly axially within the annular space.

10. The connector system of claim 1, wherein the first tubular member comprises a wellhead housing and the second tubular member comprises a riser.

11. The connector system of claim 1, wherein each of the multiple collet segments comprises a respective proximal end portion that comprises the at least one protrusion that engages the at least one groove of the body while the multiple collet segments are in the unlocked position and a respective distal end portion that is configured to contact and engage the first tubular member while the multiple collet segments are in the locked position, and the respective distal end portion is positioned axially below the body and hangs from the body while the multiple collet segments are in the unlocked position via engagement between the at least one protrusion and the at least one groove of the body.

12. A connector system, comprising:
- a body extending continuously from a first end portion to a second end portion;
- an outer sleeve positioned circumferentially about the body, wherein an annular space is defined between the body and the outer sleeve;
- an actuator assembly positioned within the annular space, wherein the actuator assembly comprises a primary piston ring and an actuator ring; and
- multiple collet segments configured to move between an unlocked position in which the multiple collet segments do not engage a first tubular member and a locked position in which the multiple collet segments engage the first tubular member, wherein the actuator assembly is configured to move in an axial direction within the annular space and relative to the outer sleeve to cause respective proximal ends of the multiple collet segments to rotate radially-outwardly and respective distal ends of the multiple collet segments to rotate radially-inwardly as the multiple collet segments move from the unlocked position to the locked position.

13. The connector system of claim 12, wherein each of the respective distal ends comprises a radially-expanded portion, a portion of the actuator ring is positioned axially above the radially-expanded portion when the multiple collet segments are in the unlocked position, and the portion of the actuator ring is positioned circumferentially about the radially-expanded portion when the multiple collet segments are in the locked position to facilitate the rotation of the respective distal ends of the multiple collet segments.

14. The connector system of claim 12, wherein the actuator assembly comprises multiple piston rods extending in the axial direction, the primary piston ring is coupled to respective first ends of the multiple piston rods, the actuator ring is coupled to respective second ends of the multiple piston rods, the primary piston ring extends radially between and seals against the body and the outer sleeve, and the actuator ring extends radially between and contacts the outer sleeve and the multiple collet segments.

15. The connector system of claim 14, comprising a retainer ring positioned axially between the primary piston ring and the actuator ring, wherein the retainer ring comprises multiple openings through which the multiple piston rods slide as the actuator assembly moves in the axial direction.

16. The system of claim 14, comprising an upper secondary unlock piston ring positioned between the primary piston ring and the actuator ring along an axial axis, wherein the upper secondary unlock piston ring is configured to move axially toward the primary piston ring to contact and exert a force against the primary piston ring to facilitate driving the multiple collet segments from the locked position to the unlocked position.

17. The connector system of claim 12, wherein the multiple collet segments comprise respective proximal end portions comprising respective radially-outwardly extending portions and respective grooves, and the actuator ring comprises a radially-inwardly extending portion that engages the respective radially-outwardly extending portions while the multiple collet segments are in the unlocked position and that engages the respective grooves while the multiple collet segments are in the locked position to facilitate rotation of the respective distal ends between the unlocked position and the locked position.

18. A method of operating a connector system to couple and to uncouple a first tubular member and a second tubular member, comprising:

providing a first fluid to a first sealed space to contact and exert a respective force on a primary piston ring to drive an actuator assembly axially in a first direction relative to an outer sleeve and within an annular space defined between a body and the outer sleeve;

rotating multiple collet segments relative to an axial axis from an unlocked position in which the multiple collet segments do not engage the first tubular member and a locked position in which the multiple collet segments engage the first tubular member as the actuator assembly moves axially in the first direction within the annular space;

providing a second fluid to a second sealed space to contact and exert a respective force on the primary piston ring or an actuator ring of the actuator assembly to drive the actuator assembly in a second direction relative to the outer sleeve and within the annular space;

providing a third fluid to a third sealed space to contact and exert a respective force on a secondary unlock piston ring to drive the actuator assembly in the second direction relative to the outer sleeve and within the annular space; and rotating the multiple collet segments relative to the axial axis from the locked position to the unlocked position as the actuator assembly moves axially in the second direction within the annular space.

19. The method of claim 18, wherein the actuator assembly comprises:

multiple piston rods extending along the axial axis;

the primary piston ring coupled to respective first ends of the multiple piston rods; and the actuator ring coupled to respective second ends of the multiple piston rods;

wherein the secondary unlock piston ring is positioned between the primary piston ring and the actuator ring along the axial axis, and providing the third fluid to the third sealed space causes the secondary unlock piston ring to contact and to drive the primary piston ring in the second direction.

20. The method of claim 18, wherein the method comprises providing the third fluid to the third sealed space in response to the second fluid in the second sealed space failing to drive the actuator assembly in the second direction.

* * * * *